US009072142B2

(12) United States Patent
Zijlstra et al.

(10) Patent No.: US 9,072,142 B2
(45) Date of Patent: Jun. 30, 2015

(54) LED LIGHTING UNIT WITH COLOR AND DIMMING CONTROL

(71) Applicant: KONINKLIJKE PHILIPS N.V., Eindhoven (NL)

(72) Inventors: Patrick John Zijlstra, Berkel-Enschot (NL); Henricus Marie Peeters, Baarlo (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/350,829

(22) PCT Filed: Jan. 2, 2013

(86) PCT No.: PCT/IB2013/050025
§ 371 (c)(1),
(2) Date: Apr. 10, 2014

(87) PCT Pub. No.: WO2013/105003
PCT Pub. Date: Jul. 18, 2013

(65) Prior Publication Data

US 2014/0333219 A1 Nov. 13, 2014

Related U.S. Application Data

(60) Provisional application No. 61/586,140, filed on Jan. 13, 2012.

(51) Int. Cl.
*H05B 33/08* (2006.01)

(52) U.S. Cl.
CPC ..... *H05B 33/0821* (2013.01); *H05B 33/0809* (2013.01); *H05B 33/086* (2013.01); *H05B 33/0845* (2013.01); *H05B 33/0857* (2013.01)

(58) Field of Classification Search
None
See application file for complete search history.

(56) References Cited

U.S. PATENT DOCUMENTS

| | | | | |
|---|---|---|---|---|
| 6,016,038 | A | 1/2000 | Mueller et al. | |
| 6,211,626 | B1 | 4/2001 | Lys et al. | |
| 2009/0021187 | A1* | 1/2009 | Bhagat | 315/297 |
| 2011/0241551 | A1* | 10/2011 | McRae | 315/130 |

FOREIGN PATENT DOCUMENTS

| | | | |
|---|---|---|---|
| JP | 6364059 | | 4/1988 |
| JP | 10337045 | | 12/1998 |
| JP | 2009283933 | A | 12/2009 |
| WO | 2005048658 | A1 | 5/2005 |
| WO | 2008110978 | A1 | 9/2008 |
| WO | 2011126106 | A1 | 10/2011 |

* cited by examiner

*Primary Examiner* — Crystal L Hammond
(74) *Attorney, Agent, or Firm* — Yuliya Mathis

(57) ABSTRACT

Method and apparatus for a LED lighting unit (200), including an inverter circuit (210) electrically coupled to a LED module (220) having a pair of antiparallel LED groupings. The inverter circuit (210) provides for color and/or dimming control of the LED module (220). A method of adjusting color and/or dimming of a LED module includes the step of cycling between a plurality of states during each of a plurality of time periods.

19 Claims, 3 Drawing Sheets

LED LIGHTING UNIT WITH COLOR AND DIMMING CONTROL

TECHNICAL FIELD

The present invention is directed generally to a LED lighting unit. More particularly, various inventive methods and apparatus disclosed herein relate to a LED lighting unit with color and dimming control.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

Some implementations of LEDs utilize a DC power supply to drive the LEDs. For example, shelf lighting and lighting for refrigerators in super markets and other stores may include LED-based light sources that utilize a DC power supply. LEDs in such implementations may be dimmable via a dimmer that is interposed between the DC power supply and the LEDs and that controls the power delivered to the LEDs through pulse width modulation (PWM). A current source may be paired with the LEDs to provide the required current for the LEDs. Although such implementations provide for dimming of LEDs, they do not provide for change of the color of the light output generated by the LEDs.

Thus, there is a need in the art to provide a LED lighting unit that may be operated by a DC power supply and that provides dimming control and color control.

SUMMARY

The present disclosure is directed to inventive methods and apparatus for a LED lighting unit. For example, a LED lighting unit may be provided that includes an inverter circuit electrically coupled to a LED module having a pair of antiparallel LED groupings. The inverter circuit may provide for color and/or dimming control of the LED module. Also, for example, a method of adjusting color and/or dimming of a LED module may be provided and may include the step of cycling between a plurality of states during each of a plurality of time periods.

Generally, in one aspect, a LED lighting unit is provided and includes an inverter circuit having a first supply connection, a second supply connection, a first LED connection, and a second LED connection. The inverter circuit can cycle between at least a first state, a second state, and a third state. In the first state the inverter circuit is configured to provide the first supply connection over the first LED connection and the second supply connection over the second LED connection. In the second state the inverter circuit is configured to provide the second supply connection over the first LED connection and the first supply connection over the second LED connection. In the third state the inverter circuit is configured to provide the second supply connection over the first LED connection and the second supply connection over the second LED connection. The LED lighting unit also includes a LED module connected between the first LED connection and the second LED connection of the inverter circuit. The LED module includes a first LED grouping and a second LED grouping that is antiparallel to the first LED grouping.

In some embodiments the LED lighting unit further includes a current source electrically coupled to the first supply connection. In some versions of those embodiments the LED module further includes a third LED grouping in series with the first LED grouping and in series with the second LED grouping.

In some embodiments, the LED lighting unit further includes a first LED current source connected between the first LED connection and the second LED connection and in series with the first LED grouping and a second LED current source connected between the first LED connection and the second LED connection and in series with the second LED grouping. In some versions of those embodiments the LED module further includes a third LED grouping in parallel with the first LED grouping and in parallel with the second LED grouping.

In some embodiments, a ratio of active time of the first state to active time of the second state is adjustable.

In some embodiments, a ratio of active time of the first state and the second state to active time of the third state is adjustable. Also, the inverter circuit may be an H-bridge circuit.

Generally, in another aspect, a LED lighting unit is provided and includes an inverter circuit, a first LED string having a plurality of first LEDs connected in series, and a second LED string having a plurality of second LEDs connected in series. The first LED string and the second LED string are connected antiparallel to one another. A first electrical connection of only two LED electrical connections extends from the inverter circuit to downstream of a last of the second LEDs and upstream of a first of the first LEDs. A second electrical connection of the only two LED electrical connections extends from the inverter circuit to upstream of a first of the second LEDs and downstream of a last of the first LEDs. The inverter circuit cycles between at least a first state and a second state during each of a plurality of time periods. In the first state the inverter circuit is configured to provide a first supply connection over the first electrical connection and a second supply connection over the second electrical connection. In the second state the inverter circuit is configured to provide the second supply connection over the first electrical connection and the first supply connection over the second electrical connection.

In some embodiments, a ratio of the duration of the first state to the second state during the time periods is adjustable.

In some embodiments, the inverter circuit cycles to a third state during a plurality of the time periods. In the third state the inverter circuit is configured to provide the second supply connection over the first electrical connection and provide the second supply connection over the second electrical connection.

In some embodiments, a ratio of the duration of the first state and the second state to the third state during the time periods is adjustable.

In some embodiments, the LED lighting unit further includes a current source electrically coupled to the first supply connection of the inverter circuit. The LED lighting unit may further include a DC power supply having a positive lead electrically coupled to the first supply connection and a negative lead electrically coupled to the second supply connection.

In some embodiments, the LED lighting unit further includes a third LED string having a plurality of third LEDs connected in series that are electrically coupled to the first LED string and the second LED string. In some versions of those embodiments the third LED string is connected in parallel with the first LED string and in parallel with the second LED string. In some other versions of those embodiments the third LED string is connected in series with the first LED string and in series with the second LED string.

Generally, in another aspect, a method of adjusting color and dimming of a LED module includes the steps of: cycling between a first state, a second state, and a third state during each of a plurality of time periods; providing, in the first state, a first supply connection over a first LED connection of only two LED connections and a second supply connection over a second LED connection of the only two LED connections; providing, in the second state, the second supply connection over the first LED connection and the first supply connection over the second LED connection; providing, in the third state, the second supply connection over the first LED connection and the second supply connection over the second LED connection; selectively adjusting a ratio of the duration of the first state to the second state during the time periods; and selectively adjusting a ratio of the duration of the first state and the second state to the third state during the time periods.

In some embodiments the method further includes the step of electrically coupling a first LED string and an antiparallel second LED string to the first LED connection and the second LED connection. In some versions of those embodiments the method further includes the step of electrically coupling a third LED string to the first LED string and the second LED string.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" or "LED lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Some implementations of LEDs utilize a DC power supply to drive the LEDs. LEDs in such implementations may be dimmable via a dimmer that is interposed between the DC power supply and the LEDs and that controls the power delivered to the LEDs through pulse width modulation (PWM). Although such implementations provide for dimming of LEDs, they do not provide for change of the color of the light output generated by the LEDs. Thus, there is a need in the art to provide a LED lighting unit that may be operated by a DC power supply and that provides dimming control and color control of the LED-based light source of the LED lighting unit.

More generally, Applicants have recognized and appreciated that it would be beneficial to provide methods and apparatus related to a LED lighting unit with color and dimming control.

In view of the foregoing, various embodiments and implementations of the present invention are directed to a LED lighting unit employing an inverter circuit having a first supply connection, a second supply connection, a first LED connection, and a second LED connection. The inverter circuit can cycle between at least a first state, a second state, and a third state.

Figure 1:
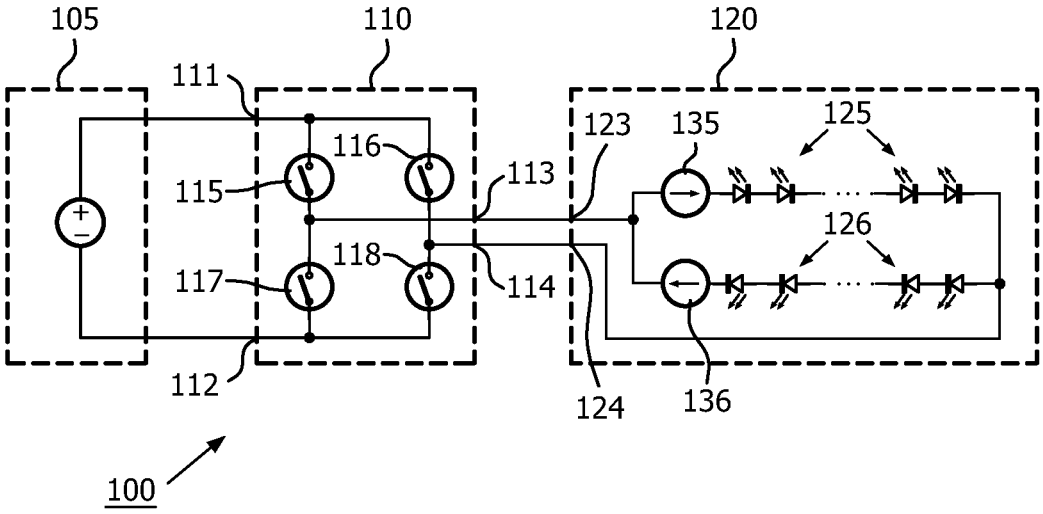
FIG. 1 illustrates a first embodiment of a LED lighting unit.
Figure 2:
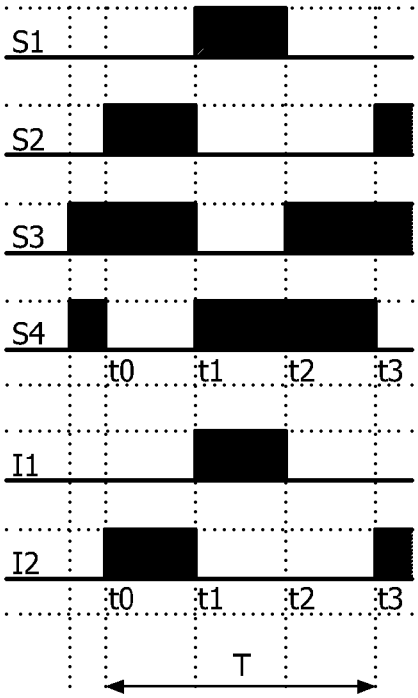
FIG. 2 illustrates an embodiment of a switching sequence that may be utilized with the LED lighting unit of FIG. 1.

Referring initially to FIGS. 1 and 2, a first embodiment of a LED lighting unit 100 is illustrated. The LED lighting unit 100 includes an inverter circuit 110 and a LED module 120 electrically coupled to the inverter circuit 110 via only two wires. A DC power supply 105 is also illustrated and is coupled to the inverter circuit 110. In some embodiment the DC power supply 105 may be a power supply utilized in shelf lighting and lighting for refrigerators in super markets and/or other stores. In some embodiments the DC power supply 105 may be an approximately 24 Volt power supply. The positive lead of the DC power supply 105 is electrically coupled to a first supply input 111 of the inverter circuit 110 and the negative lead of the DC power supply 105 is electrically coupled to a second supply input 112 of the inverter circuit 110.

In various embodiments, the illustrated inverter circuit 110 is an H bridge type inverter and includes four separate switches 115-118. In some embodiments, the switches 115-118 may include solid-state switches. In some versions of those embodiments, the switches 115-118 may include a plurality of MOSFETS. For example, the third switch 117 and the fourth switch 118 may be NMOS FETS and the first switch 115 and the second switch 116 may be PMOS FETS. One of ordinary skill in the art, having had the benefit of the present disclosure, will recognize and appreciate that in alternative embodiments other solid-state and/or mechanical switch configurations may additionally or alternatively be utilized. Also, one of ordinary skill in the art, having had the benefit of the present disclosure, will recognize and appreciate that although a specific H bridge circuit is illustrated, in alternative embodiments other inverter circuits may alternatively be utilized.

A first LED electrical output 113 is electrically connected between the first switch 115 and the third switch 117 and to a first input 123 of the LED module 120. A second LED electrical output 114 is electrically connected between the second switch 116 and the fourth switch 118 and to a second input 124 of the LED module 120. The LED module 120 includes a first grouping of LEDs that includes a plurality of LEDs 125 connected in series and a second grouping of LEDs that includes a plurality of LEDs 126 connected in series. Although four LEDs 125 and four LEDs 126 are illustrated, in other embodiments more or fewer LEDs 125 and/or 126 may be provided. The first LED grouping and the second LED grouping are antiparallel to one another. That is, the first LED grouping and the second LED grouping are connected in parallel, but with their polarities reversed. The first LED grouping has a first current source 135 in series therewith to realize the required current for the LEDs 125 and the second LED grouping has a second current source 136 in series therewith to realize the required current for the LEDs 126. The first input 123 is coupled to one side of the antiparallel connection between the LED modules and the second input 124 is coupled to the other side of the antiparallel connection between the LED modules.

In some embodiments, the first LED grouping and/or the first LED current source 135 may be configured such that the first LED grouping generates a first color of light output when illuminating and the second LED grouping and/or the second LED current source 136 may be configured such that the second LED grouping generates a second color of light output when illuminating. For example, the first LED grouping may be configured to generate a first color temperature of white light and the second LED grouping may be configured to generate a second color temperature of white light. In some embodiments the first LED grouping and/or the second LED grouping may optionally be provided on a printed circuit board (PCB).

The inverter circuit 110 is switchable between at least three states in some embodiments. In some other embodiments the inverter circuit 110 is only switchable between two states (e.g., only the first and second states described below). In a first state the first switch 115 and the fourth switch 118 are conducting and the second switch 116 and the third switch 117 are not conducting. Accordingly, in the first state the inverter circuit 110 is providing the first supply connection 111 over the first LED electrical output 113 and the second supply connection 112 over the second LED electrical output 114, resulting in a current 12 being generated by current source 136 and illumination of the second LEDs 126 (while the first LEDs 125 are in an off state).

In a second state the second switch 116 and the third switch 117 are conducting and the first switch 115 and the fourth switch 118 are not conducting. Accordingly, in the second state the inverter circuit 110 is providing the second supply connection 112 over the first LED electrical output 113 and the first supply connection 111 over the second LED electrical output 114, resulting in a current 11 being generated by current source 135 and illumination of the first LEDs 125 (while the second LEDs 126 are in an off state).

In a third state the third switch 117 and the fourth switch 118 are both conducting and the first switch 115 and the second switch 116 are not conducting. Accordingly, in the third state the inverter circuit 110 is providing the second supply connection 112 over the first electrical output 113 and over the second electrical output 114, resulting in no current being generated by either of current sources 135, 136 and the LEDs 125, 126 all being in an off state. In the third state the LED module 120 is still connected to the DC power supply 105.

The inverter circuit 110 cycles between the first state, the second state, and/or the third state during each of a plurality of time periods. A controller may optionally be paired with or integrated with the inverter circuit 110 to control the duration of each of the first state, the second state, and/or the third state during each of a plurality of time periods. In embodiments where the first grouping of LEDs and the second grouping of LEDs generate different colors of light outputs, the ratio of the duration of the first state to the duration of the second state during a time period will determine the effective color of generated light output. Accordingly, in those embodiments adjustment of the ratio of the duration of the first state to the duration of the second state will shift the color temperature of light output from the LED module 120. The ratio of the duration of the first state and the second state combined to the duration of the third state during a time period will determine the effective intensity of generated light output. Accordingly, adjustment of the ratio of the duration of the first state and the second state combined to the duration of the third state will adjust the dimming of the light output from the LED module 120.

Referring particularly to FIG. 2, an embodiment of a switching sequence over a time period T is illustrated. In FIG. 2 'S1' references first switch 115, 'S2' references second switch 116, 'S3' references third switch 117, 'S4' references fourth switch 118,'I1' references current source 135, and 'I2' references current source 136. Between times t0 and t1 second switch 116 and third switch 117 are conducting (the second state described above), resulting in a current I2 and illumination of LEDs 126. Between times t1 and t2 the first switch 115 and the fourth switch 118 are conducting (the first state described above), resulting in a current I1 and illumination of LEDs 125. Between times t2 and t3 the third switch 117 and the fourth switch 118 are conducting (the third state described above), resulting in an off state of the LEDs 125, 126.

Assuming for a moment that the time period t0-t1 references the duration of the first state during a time period, the time period t1-t2 references the duration of the second state during the time period, and the time period t2-t3 references the duration of the third state during the time period: when LED modules of different colors are provided, adjusting the ratio of the duration of t0-t1 to t1-t2 will adjust the color temperature; also, adjusting the ratio of the duration of t0-t2 to t2-t3 will adjust the light output intensity.

The color temperature and/or light output intensity may be adjusted utilizing, for example, a controller interfacing with inverter circuit 110. In some embodiments the color temperature and/or light output may be automatically adjusted based on feedback from one or more sensors (e.g., photodetectors measuring light output from LED module 120). In some embodiments the color temperature and/or light output may be adjusted based on input from a user via a user interface in electrical communication with the inverter circuit 110. In some embodiments the color temperature and/or light output may be adjusted based on network communications directed toward the LED lighting unit 100. For example, in some embodiments radio frequency identification (RFID) or other wireless communication may be utilized to set a desired color temperature and/or light output level after installation of the LED lighting unit 100. Although a specific switching sequence is illustrated in FIG. 2, one of ordinary skill in the art, having had the benefit of the present disclosure, will recognize and appreciate that other switching sequences may additionally or alternatively be provided. For example, in some embodiments the third state may be interposed between the first state and the second state. Also, for example, in some embodiments the dimming level and/or color temperature may be adjusted by a user to a level such that one or more of the first state, the second state, and the third state are not present in a switching cycle. For example, only the first state and the third state may be present in a switching cycle to achieve a certain desired color temperature.

In some embodiments, the inverter circuit 110 may also be capable of electrical connection to a LED module that only includes a single grouping of LEDs connected in series without a second grouping of LEDs connected antiparallel to the first grouping. The inverter circuit 110 may still be able to provide illumination to the LEDs of such a grouping and effectuate dimming in such a grouping. For example, the first LED electrical output 113 of the inverter circuit 110 may be coupled to a first end of the series LEDs and the second LED electrical output 114 of the inverter circuit may be coupled to the second end of the series LEDs. For example, in the first state the inverter circuit 110 may cause the LEDs to be illuminated and in the second and/or third state the inverter circuit 110 may cause the LEDs to be off. Accordingly, by adjusting the ratio between the first state and the second and/or third state in such an example, dimming of the LED module may be effectuated. In some embodiments the LED module 120 may also be capable of electrical connection to a standard dimmer. The dimmer can be connected to the LED module so that either the first LED grouping or the second LED grouping (based on polarity of the connection) is illuminated and the illuminated LED module can be controlled with the dimmer. Accordingly, in certain installations the inverter circuit 110 may be installed in combination with different LED modules and/or the LED module 120 may be installed in combination with a standard dimmer. In the illustrated embodiments only two wires are connected between the inverter circuit and the LED module. This may facilitate installation of the LED module 120 and/or inverter circuit 110 in two-wire environments. In the illustrated embodiments no separate control circuitry is required with the LED module for control of color and/or dimming of the LEDs and all control of color and dimming is realized at the inverter circuit.

Figure 3:
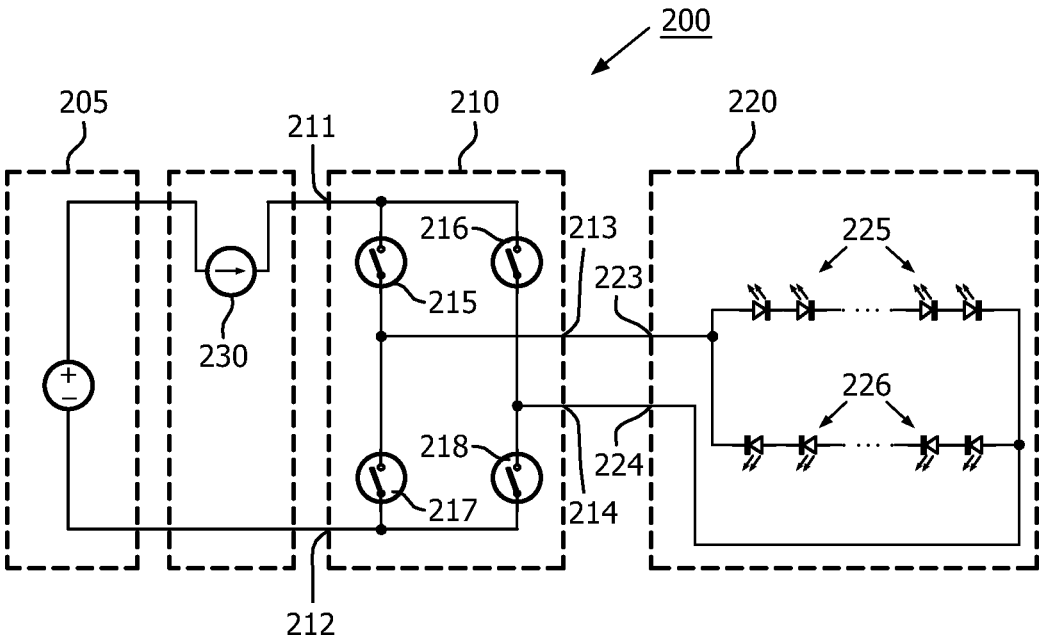
FIG. 3 illustrates a second embodiment of a LED lighting unit.

Referring now to FIG. 3, a second embodiment of a LED lighting unit 200 is illustrated. The LED lighting unit 200 includes an inverter circuit 210 and a LED module 220 electrically coupled to the inverter circuit 210. A DC power supply 205 is also illustrated. The positive lead of the DC power supply 205 is electrically coupled to a current source 230 which is electrically coupled to a first supply input 211 of the inverter circuit 210 and the negative lead of the DC power supply 205 is electrically coupled to a second supply input 212 of the inverter circuit 210.

The inverter circuit 210 is an H bridge type inverter and includes four separate switches 215-218. A first LED electrical output 213 is electrically connected between the first switch 215 and the third switch 217 and to a first input 223 of the LED module 220. A second LED electrical output 214 is electrically connected between the second switch 216 and the fourth switch 218 and to a second input 224 of the LED module 220. The LED module 220 includes a first grouping of LEDs that includes a plurality of LEDs 225 connected in series and a second grouping of LEDs that includes a plurality of LEDs 226 connected in series. The first LED grouping and the second LED grouping are antiparallel to one another. Although four LEDs 225 and four LEDs 226 are illustrated, in other embodiments more or fewer LEDs 225 and/or 226 may be provided. The current source 230 provided upstream of the inverter circuit 210 makes the inverter circuit 210 a current inverter. Any current sources that may optionally be provided in combination with the LED groupings of LED modules 220 will be redundant. In some embodiments the first LED grouping may be configured to generate a first color of light output when illuminating and the second LED grouping may be configured to generate a second color of light output when illuminating.

The inverter circuit 210 may be switchable between at least three states to effectuate shifting of color temperature and/or light output intensity of LED module 220. For example, the inverter circuit 210 may be switchable in a similar manner as that described in combination with inverter circuit 110 of LED lighting unit 100.

Figure 4:
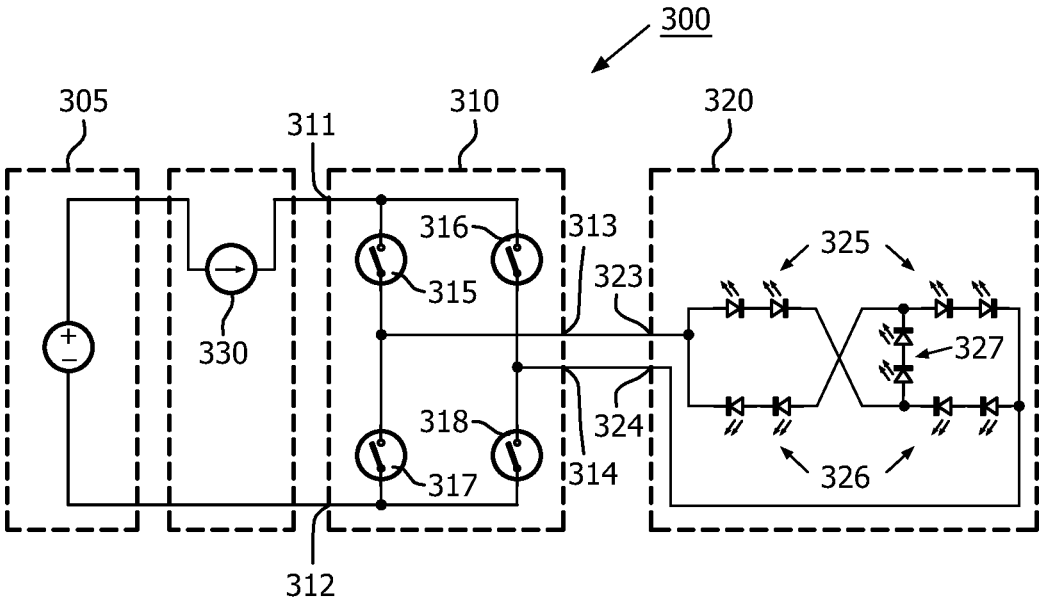
FIG. 4 illustrates a third embodiment of a LED lighting unit.

Referring now to FIG. 4, a third embodiment of a LED lighting unit 300 is illustrated. The LED lighting unit 300 includes an inverter circuit 310 and a LED module 320 electrically coupled to the inverter circuit 310. A DC power supply 305 is also illustrated and has a positive lead electrically coupled to a current source 330 (which is coupled to a first supply input 311 of the inverter circuit 310) and a negative lead electrically coupled to a second supply input 312 of the inverter circuit 310.

The inverter circuit 310 includes a first LED electrical output 313 electrically connected between a first switch 315 and a third switch 317 and to a first input 323 of the LED module 320. A second LED electrical output 314 is electrically connected between the second switch 316 and the fourth switch 318 and to a second input 324 of the LED module 320. The LED module 320 includes a first grouping of LEDs that includes a plurality of LEDs 325 connected in series and a second grouping of LEDs that includes a plurality of LEDs 326 connected in series. The first LED grouping and the second LED grouping are antiparallel to one another.

The LED module 320 also includes a third grouping of LEDs that includes a plurality of LEDs 327 connected in series. The third grouping of LEDs is connected in series with the first LED grouping and is also connected in series with the second LED grouping. Accordingly, the third grouping of LEDs is illuminated when the first grouping of LEDs is illuminated and is also illuminated when the second grouping of LEDs is illuminated. In some embodiments the first LED grouping may be configured to generate a first color of light output when illuminating, the second LED grouping may be configured to generate a second color of light output when illuminating, and the third grouping of LEDs may be configured to generate a third color of light output when illuminating. In some embodiments the third grouping of LEDs may be red. Providing a third grouping of LEDs may improve color rendering. Although four LEDs 325, four LEDs 326, and two LEDs 327 are illustrated, in other embodiments more or fewer LEDs 325, 326, and/or 327 may be provided.

The inverter circuit 310 may be switchable between at least three states to effectuate shifting of the color temperature and/or light output intensity of LED module 320. For example, the inverter circuit 310 may be switchable in a similar manner as that described in combination with inverter circuit 110 of LED lighting unit 100. Although the color output of the third grouping cannot be independently controlled via inverter circuit 310, the color output of the first and second groupings can still be independently controlled via inverter circuit 310. The dimming level of the LED module 320 as a whole can be controlled via inverter circuit 310. Any current sources that may optionally be provided in combination with the LED groupings of LED module 320 will be redundant.

Figure 5:
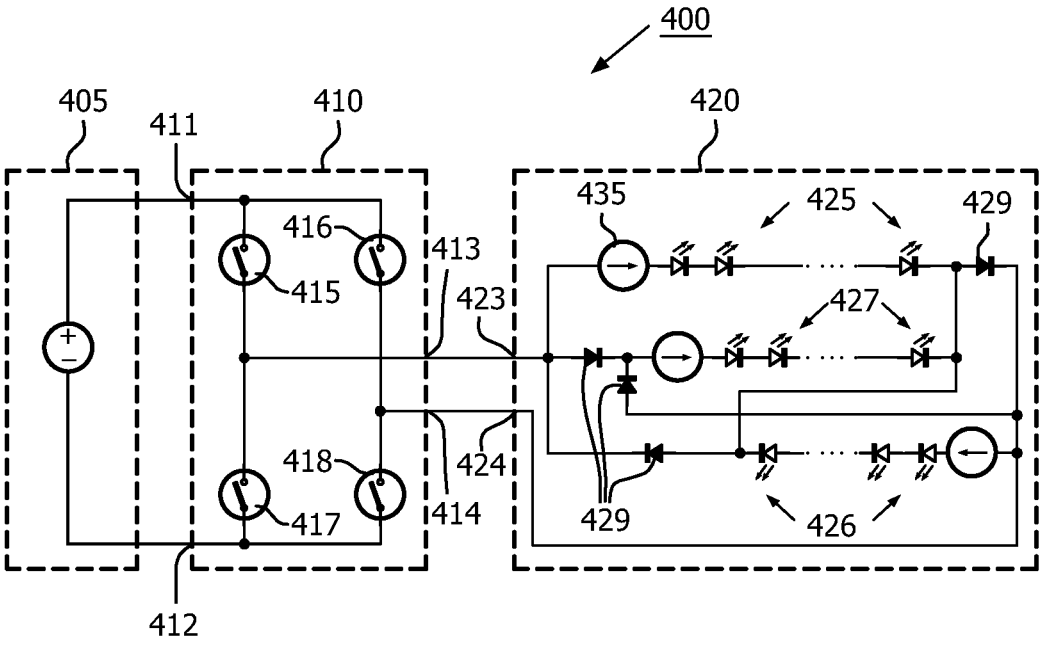
FIG. 5 illustrates a fourth embodiment of a LED lighting unit.

Referring now to FIG. 5, a fourth embodiment of a LED lighting unit 400 is illustrated. The LED lighting unit 400 includes an inverter circuit 410 and a LED module 420 electrically coupled to the inverter circuit 410. A DC power supply 405 is also illustrated and has a positive lead electrically coupled to a first supply input 411 of the inverter circuit 410 and a negative lead electrically coupled to a second supply input 412 of the inverter circuit 410.

The inverter circuit 420 includes a first LED electrical output 413 electrically connected between a first switch 415 and a third switch 417 and to a first input 423 of the LED module 420. A second LED electrical output 414 is electrically connected between the second switch 416 and the fourth switch 418 and to a second input 424 of the LED module 420. The LED module 420 includes a first grouping of LEDs that includes a plurality of LEDs 425 connected in series and a second grouping of LEDs that includes a plurality of LEDs 426 connected in series. The first LED grouping and the second LED grouping are antiparallel to one another. The first LED grouping has a first current source 435 in series therewith to realize the required current for the LEDs 425 and the second LED grouping has a second current source 436 in series therewith to realize the required current for the LEDs 426.

The LED module 420 also includes a third grouping of LEDs that includes a plurality of LEDs 427 connected in series. The third LED grouping has a third current source 437 in series therewith to realize the required current for the LEDs 427. The third grouping of LEDs is connected in parallel with the first LED grouping and is connected in parallel with the second LED grouping. Four diodes 429 are also included to ensure proper polarity is provided to the three LED groupings during each of the states of the inverter circuit 410. In the illustrated arrangement of FIG. 5 the third grouping of LEDs is illuminated when the first grouping of LEDs is illuminated and is also illuminated when the second grouping of LEDs is illuminated. In some embodiments the first LED grouping may be configured to generate a first color of light output when illuminating, the second LED grouping may be configured to generate a second color of light output when illuminating, and the third grouping of LEDs may be configured to generate a third color of light output when illuminating. In some embodiments the third grouping of LEDs may be red. Providing a third grouping of LEDs may improve color rendering. Although three LEDs 425, three LEDs 426, and three LEDs 427 are illustrated, in other embodiments more or fewer LEDs 425, 426, and/or 427 may be provided.

The inverter circuit 410 may be switchable between at least three states to effectuate shifting of color temperature and or light output intensity of LED module 420. For example, the inverter circuit 410 may be switchable in a similar manner as that described in combination with inverter circuit 110 of LED lighting unit 100. Although the color output of the third grouping cannot be independently controlled via inverter circuit 410, the color output of the first and second groupings can still be independently controlled via inverter circuit 410. The dimming level of the LED module 420 as a whole can be controlled via inverter circuit 410. Any current sources that may optionally be provided in combination with the LED groupings of LED module 420 will be redundant.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein.

More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

Reference numerals appearing between the parentheses in the claims are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

What is claimed is:

1. A LED lighting unit, comprising:

an inverter circuit having a first supply connection, a second supply connection, a first LED connection, and a second LED connection;

said inverter circuit cyclable between at least a first state, a second state, and a third state;

wherein in said first state said inverter circuit is configured to provide said first supply connection over said first LED connection and said second supply connection over said second LED connection;

wherein in said second state said inverter circuit is configured to provide said second supply connection over said first LED connection and said first supply connection over said second LED connection;

wherein in said third state said inverter circuit is configured to provide said second supply connection over said first LED connection and said second supply connection over said second LED connection;

a LED module connected between said first LED connection and said second LED connection of said inverter circuit , said LED module including a first LED grouping and a second LED grouping , said second LED grouping antiparallel to said first LED grouping.

2. The LED lighting unit of claim 1 further comprising a current source electrically coupled to said first supply connection.

3. The LED lighting unit of claim 2 wherein said LED module further includes a third LED grouping in series with said first LED grouping and in series with said second LED grouping.

4. The LED lighting unit of claim 1 further comprising a first LED current source connected between said first LED connection and said second LED connection and in series with said first LED grouping; and a second LED current source connected between said first LED connection and said second LED connection and in series with said second LED grouping.

5. The LED lighting unit of claim 4 wherein said LED module further includes a third LED grouping in parallel with said first LED grouping and in parallel with said second LED grouping.

6. The LED lighting unit of claim 1 wherein the inverter circuit is configured to adjust a ratio of active time of said first state to active time of said second state.

7. The LED lighting unit of claim 6 wherein a ratio of active time of said first state and said second state to active time of said third state is adjustable.

8. The LED lighting unit of claim 1 wherein said inverter circuit is an H bridge circuit.

9. A LED lighting unit, comprising:

an inverter circuit;

a first LED string having a plurality of first LEDs connected in series;

a second LED string having a plurality of second LEDs connected in series;

wherein said first LED string and said second LED string are connected antiparallel to one another;

a first electrical connection of only two LED electrical connections extending from said inverter circuit to downstream of a last of said second LEDs and upstream of a first of said first LEDs; and a second electrical connection of said only two LED electrical connections extending from said inverter circuit to upstream of a first of said second LEDs and downstream of a last of said first LEDs;

wherein said inverter circuit cycles between a first state, a second state and a third state during each of a plurality of time periods;

wherein in said first state said inverter circuit is configured to provide a first supply connection over said first electrical connection and a second supply connection over said second electrical connection; and wherein in said second state said inverter circuit is configured to provide said second supply connection over said first electrical connection and said first supply connection over said second electrical connection, wherein in said third state said inverter circuit is configured to provide said second supply connection over said first electrical connection and provide said second supply connection over said second electrical connection.

10. The LED lighting unit of claim 9, wherein a ratio of the duration of said first state to said second state during said time periods is adjustable.

11. The LED lighting unit of claim 9, wherein a ratio of the duration of said first state and said second state to said third state during said time periods is adjustable.

12. The LED lighting unit of claim 9, further comprising a current source electrically coupled to said first supply connection of said inverter circuit.

13. The LED lighting unit of claim 9, further comprising a DC power supply having a positive lead electrically coupled to said first supply connection and a negative lead electrically coupled to said second supply connection.

14. The LED lighting unit of claim 9 further comprising a third LED string having a plurality of third LEDs connected in series, said third LEDs electrically coupled to said first LED string and said second LED string.

15. The LED lighting unit of claim 14, wherein said third LED string is connected in parallel with said first LED string and in parallel with said second LED string.

16. The LED lighting unit of claim 14, wherein said third LED string is connected in series with said first LED string and in series with said second LED string.

17. A method of adjusting color and dimming of a LED module, comprising:

cycling between a first state, a second state, and a third state during each of a plurality of time periods;

providing, in said first state, a first supply connection over a first LED connection of only two LED connections and a second supply connection over a second LED connection of said only two LED connections;

providing, in said second state, said second supply connection over said first LED connection and said first supply connection over said second LED connection;

providing, in said third state, said second supply connection over said first LED connection and said second supply connection over said second LED connection;

selectively adjusting a ratio of the duration of said first state to said second state during said time periods; and selectively adjusting a ratio of the duration of said first state and said second state to said third state during said time periods.

18. The method of claim 17 further comprising electrically coupling a first LED string and an antiparallel second LED string to said first LED connection and said second LED connection.

19. The method of claim 18 further comprising electrically coupling a third LED string to said first LED string and said second LED string.

* * * * *